US012590434B2

(12) United States Patent
Cai et al.

(10) Patent No.: US 12,590,434 B2
(45) Date of Patent: Mar. 31, 2026

(54) RANGE-EXTENDED NUMERICAL CONTROLLED LINK MECHANISM ELECTRIC LOADER

(71) Applicant: Guangxi University, Guangxi (CN)

(72) Inventors: Ganwei Cai, Guangxi (CN); Junwei Tian, Guangxi (CN); Wei Wei, Guangxi (CN)

(73) Assignee: GUANGXI UNIVERSITY, Guangxi (CN)

( * ) Notice: Subject to any disclaimer, the term of this patent is extended or adjusted under 35 U.S.C. 154(b) by 270 days.

(21) Appl. No.: 18/449,954

(22) Filed: Aug. 15, 2023

(65) Prior Publication Data

US 2024/0060266 A1 Feb. 22, 2024

(30) Foreign Application Priority Data

Aug. 19, 2022 (CN) ..... 202211000495.9

(51) Int. Cl.
*E02F 3/38* (2006.01)
*E02F 3/42* (2006.01)

(52) U.S. Cl.
CPC ..... *E02F 3/38* (2013.01); *E02F 3/422* (2013.01)

(58) Field of Classification Search
CPC . E02F 3/38; E02F 3/422; E02F 3/3408; E02F 9/202; E02F 9/2075; E02F 3/36; E02F 3/42; E02F 3/425; B60W 2300/12; B60W 2300/17; B60W 2510/244; B60W 10/02; B60W 10/06; B60W 10/08; B60W 10/115; B60W 10/26; B60W 10/30; B60W 20/10; B60W 20/11; B60W 20/13; B60W 20/20; B60W 20/40; B60W 30/182; B60K 6/365; B60K 6/387; B60K 6/40;

(Continued)

(56) References Cited

U.S. PATENT DOCUMENTS

2008/0053723 A1* 3/2008 Kozarekar ..... B60K 6/445 180/65.23
2011/0111905 A1* 5/2011 Tiwari ..... B60K 6/445 475/5

(Continued)

FOREIGN PATENT DOCUMENTS

CN 105804129 A * 7/2016 ..... E02F 3/42

*Primary Examiner* — Farhana Pervin
(74) *Attorney, Agent, or Firm* — MUNCY, GEISSLER, OLDS & LOWE, P.C.

(57) ABSTRACT

A range-extended numerical controlled link mechanism electric loader comprising a vehicle-loaded rechargeable energy storage device, a vehicle-loaded auxiliary power supply device, a motor, a reducer, a numerical controlled link lever loading mechanism and a rack. The vehicle-loaded rechargeable energy storage device comprises at least a battery, an electric control module, and at least one charging port; the vehicle-loaded auxiliary power supply device comprises an engine and a generator; by cooperation of the vehicle-loaded rechargeable energy storage device and the vehicle-loaded auxiliary power supply device the loader can have five different working modes: low speed mode, high speed mode, hybrid low speed mode, hybrid high speed mode and energy recycling mode, by the different working modes, the wheels can be driven to rotate or the drive levers can be driven to conduct loading work.

3 Claims, 5 Drawing Sheets

(58) Field of Classification Search
CPC .. B60K 6/442; B60K 2006/266; B60K 17/02; B60K 17/04; Y02T 10/70; B60L 50/62
See application file for complete search history.

(56) References Cited

U.S. PATENT DOCUMENTS

| | | | | |
|---|---|---|---|---|
| 2014/0148984 | A1* | 5/2014 | Nishi | B60W 20/10 180/65.265 |
| 2015/0151626 | A1* | 6/2015 | Choi | B60K 6/387 903/910 |
| 2016/0153174 | A1* | 6/2016 | Naito | E02F 9/02 903/910 |
| 2018/0355624 | A1* | 12/2018 | Del Real | E01C 19/42 |
| 2022/0242483 | A1* | 8/2022 | Kikuchi | E02F 9/202 |
| 2023/0264584 | A1* | 8/2023 | Ortiz | B60L 53/38 307/104 |

* cited by examiner

RANGE-EXTENDED NUMERICAL CONTROLLED LINK MECHANISM ELECTRIC LOADER

TECHNICAL FIELD

The present invention relates to the technical field of loaders, especially a range-extended numerical controlled link mechanism electric loader.

BACKGROUND TECHNOLOGY

Construction machinery are general terms of machineries for construction purposes, and loaders are one of the most important construction machineries. Loaders are earthwork construction machineries that have been widely used in road, railway, building, mining construction projects, are mostly used to scoop and load materials such as earth and stones and loaders can also perform some shoveling work for mine ores and hard earth. Loaders currently available comprise mechanical transmission loaders and hydraulic transmission loaders. Mechanical loaders can only complete simple motions, and there are many motions that mechanical loaders cannot perform; hydraulic loaders have advantages such as good maneuverability and being flexible, and have been widely used in a variety of fields, hydraulic loaders can be flexibly used to conduct a plurality of construction movements, however, there are defects of high requirements on components of hydraulic systems, short life, oil leakage liability, and for a long term, these difficulties have not been successfully solved and breakthrough. in the construction mechanical field. Output motions of multiple degrees of freedom link mechanisms are dictated by a plurality of driving levers, and are a function of multiple independent variables, with the presence of appropriate control programs, complex movements can be realized, and by changing the control programs the output movements of the mechanisms can be changed, in this way, the output is flexible. Furthermore, motors can be mounted on the racks, problems of poor rigidity and high inertia at hinging connection points can be avoided. To realize random track outputs, the multiple degrees of freedom numerical controlled link mechanisms can only be driven by numerical controlled motors, when being driven by a plurality of coordinated numerical controlled motors, the output ends of the mechanisms can realize motions required by the loaders, as batteries have limited capacity, service life of multiple degrees of freedom numerical controlled link mechanism loaders is short, and application scopes thereof are narrow.

Batteries of the multiple degrees of freedom numerical controlled link mechanism electric loaders have to have very big capacities to satisfy requirements of endurance mileages and digging working time, deep discharge of batteries will adversely affect the service life of the batteries, furthermore, high power charging stations or battery swapping stations are required, and when charging is not convenient, the loaders can only be moved by trailer trucks.

SUMMARY OF THE INVENTION

A purpose of the present invention is to provide a range-extended numerical controlled link mechanism electric loader to address the problems that components of hydraulic systems have high requirements on components of hydraulic systems, short lives and are liable to leak oil, capacities of batteries of multiple degrees of freedom numerical controlled link mechanism electric loaders have to be very big to satisfy requirements of sufficient endurance mileages and digging working time, and sometimes trailer trucks have to be used to move the loaders when charging is not convenient, so that, when the batteries cannot meet requirements on endurance mileages or loading working time, by turning on or switching to a device power can be supplied to the batteries and endurance mileages or loading working time can be met instead of stopping nearby to charge the batteries, further, when the range-extended numerical controlled link mechanism electric loader is not travelling nor loading, charging of the batteries can be done by externally connecting a power supply device, also it is possible to switch working modes as per actual situations. Furthermore, working requirements of loaders shall be satisfied and just as hydraulic loaders, the electric loaders have advantages such as big loading capacities and good bearing abilities, in this way, disadvantages of conventional hydraulic loaders such as high maintenance cost and insufficiently flexible response can be overcome.

To meet the foregoing purposes, the present invention uses the following technical solution:

A range-extended numerical controlled link mechanism electric loader proposed in the present invention, comprising a rack, a numerical controlled link lever loading mechanism, wheels and a drive system, wherein, the drive system is provided on the rack, drive levers of the numerical controlled link lever loading mechanism are connected with an output end of the drive system via at least one clutch, the wheels are provided at a lower portion of the rack, and the wheels are connected with the output end of the drive system via the at least one clutch, The drive system comprises: an engine, a generator, at least one battery, a motor, the at least one clutch, an electric control module, a power distribution mechanism and a reducer, a rotation shaft of the engine is connected with a clutch C3, the clutch C3 is connected with an end of a main shaft of the generator, a clutch C2 is connected at another end of the main shaft of the generator, the clutch C2 is connected with the power distribution mechanism, the power distribution mechanism is connected with a main shaft of the motor; the power distribution mechanism comprises a planetary gear system, a planet pinion carrier of the planetary gear system is connected with a drive shaft of the reducer, a driven shaft of the reducer is connected with a controller of the wheels and the drive shaft and then connected with the wheels and the drive shaft; a sun gear of the planetary gear system is connected with a rotating shaft of the motor, a gear ring of the planetary gear system is connected with a housing or the main shaft of the generator as per control requirements; the generator is connected with the electric control module via cables and wires and the at least one battery is connected with the electric control module via the cables and wires and then connected with the motor. The numerical controlled link lever loading mechanism comprises a first drive lever, a first link lever, a rocker arm, a first tension lever, a second tension lever, a movable arm, a loader bucket, and a movable arm elevating mechanism, an end of the movable arm is sequentially connected with a first revolute joint, a second revolute joint and then the rack, another end of the movable arm is connected with the loader bucket via a third revolute joint and a fourth revolute joint, an end of the movable arm elevating mechanism is connected with the rack and another end thereof is connected with the movable arm, an end of the first drive lever is connected to the rack via a fifth revolute joint, another end of the first drive lever is connected with the first link lever via a sixth revolute joint, another end of the first link lever is connected with an end of the rocker arm via a seventh revolute joint, another end of the rocker arm is connected with the first link lever via an eighth revolute joint, another two ends of the rocker arm are respectively connected with the first tension lever and the second tension lever via a ninth revolute joint and a tenth revolute joint, another ends of the first tension lever and the second tension lever are connected with the loader bucket via an eleventh revolute joint and a twelfth revolute joint, the first drive lever driven by the motor located on the rack rotates against the revolute joints, movement is transmitted via the first link lever, the rocker arm, the first tension lever and the second tension lever, thereafter, the loader bucket pivots against the third revolute joint and the fourth revolute joint on the movable arm; the movable arm elevating mechanism comprises a second drive lever, a second link lever, a third drive lever and a third link lever, either ends of the second drive lever and the third drive lever are respectively connected to the rack via a thirteenth revolute joint and a fourteenth revolute joint, another ends thereof are respectively connected with the second link lever and the third link lever via a fifteenth revolute joint and a sixteenth revolute joint, and the second link lever and the third link lever are respectively connected with the movable arm via a seventeenth revolute joint and an eighteenth revolute joint.

The electric control module comprises a rectifier module, an inverter module and a rectification driving module, wherein the rectifier module and the inverter module are connected in between the generator and the at least one battery in parallel, switches are provided respectively on the rectifier module and the invertor module; and the rectification driving module is provided in between the at least one battery and the motor.

The electric control module further comprises a charging module, wherein charging ports are connected in the charging module.

The drive system has five working modes, respectively low speed mode, high speed mode, hybrid low speed mode, hybrid high speed mode and energy recycling mode, wherein under the low speed mode, the clutch between the engine and the generator is released, the clutch between the generator and the motor is released, the engine is not working, the at least one battery supplies power to the motor, and the clutch in between the motor and the reducer is engaged, the reducer drives the wheels and/or the drive lever.

Under the high speed mode, the clutch between the engine and the generator is disengaged, the clutch in between the generator and the motor is engaged, the at least one battery supplies power to both the generator and the motor, the clutch in between the motor and the reducer is engaged, and the reducer drives the wheels and/or drive lever.

Under the hybrid low speed mode, the clutch in between the engine and the generator is engaged, the clutch in between the generator and the motor is disengaged, the generator feeds power to the batteries, the at least one battery supplies power to the motor, the clutch in between the motor and the reducer is engaged, and the reducer drives the wheels and/or drive lever.

Under the hybrid high speed mode, the clutch in between the engine and the generator is engaged, the clutch in between the generator and the motor is engaged, the generator feeds power to the batteries, the at least one battery supplies power to the motor, the clutch in between the motor and the reducer is engaged, and the reducer drives the wheels and/or drive lever.

Under the energy recycling mode, the clutch in between the engine and the generator is disengaged, the clutch in between the generator and the motor is disengaged, the wheels drive the motor to rotate, and power generated by rotation of the motor energizes the rectification driving module.

Advantageous effects of the present invention are:

(1) The output motions of the multiple degrees of freedom numerical controlled link lever loading mechanism are dictated jointly by multiple drive components, and are a function with many independent variables, with an appropriate control program complex movements can be realized, by changing the control program the output motions of the mechanism can be changed, that is, output is flexible.

(2) For the range-extended numerical controlled link mechanism electric loader, when the battery has sufficient power, the battery will drive the motor, and supply the power required for driving the entire vehicle, and at this time, the engine is not working. When power in the battery has been consumed to a certain extent, the engine is started and will provide the energy to charge the batteries, as long as there is a fuel oil station the vehicle can always run, so when it is not convenient to charge the battery, the loader does not have to be transported via a trailer truck, so the problem of insufficient infrastructures has been addressed, when the batteries have sufficient power, the engine will stop working, the batteries will drive the motor and drive the entire vehicle, in this way, the recharge mileage and loading working time of the range-extended numerical controlled link mechanism electrode loader can be satisfied without requiring stopping and finding charging stations to charge the batteries.

(3) For the range-extended numerical controlled link mechanism electric loader, no large charging facilities are required, by charging at night at charging stations, and using the power in the batteries at daytime properly, the power of the fuel engine has been saved, the rate of economizing fuel has been improved, the engine can always be in an optimum working state, in the meanwhile, the loader is provided with braking energy recycling function, the batteries can charge and discharge partially rather than fully, the service life of the batteries can be prolonged.

(4) The range-extended numerical controlled link mechanism electric loader can run in a purely electric mode, and compared with common electric loaders, capacities of the batteries required is smaller, the cost is lower and stoppage due to electric shortage will not occur. In the present invention, all of working requirements of hydraulic loaders can be met, also the loader is quick in response, sensitive and highly efficient, and has overcome the deficiency of high repair and maintenance cost and liability of the hydraulic oil pipelines to environment influences.

Figure 1:
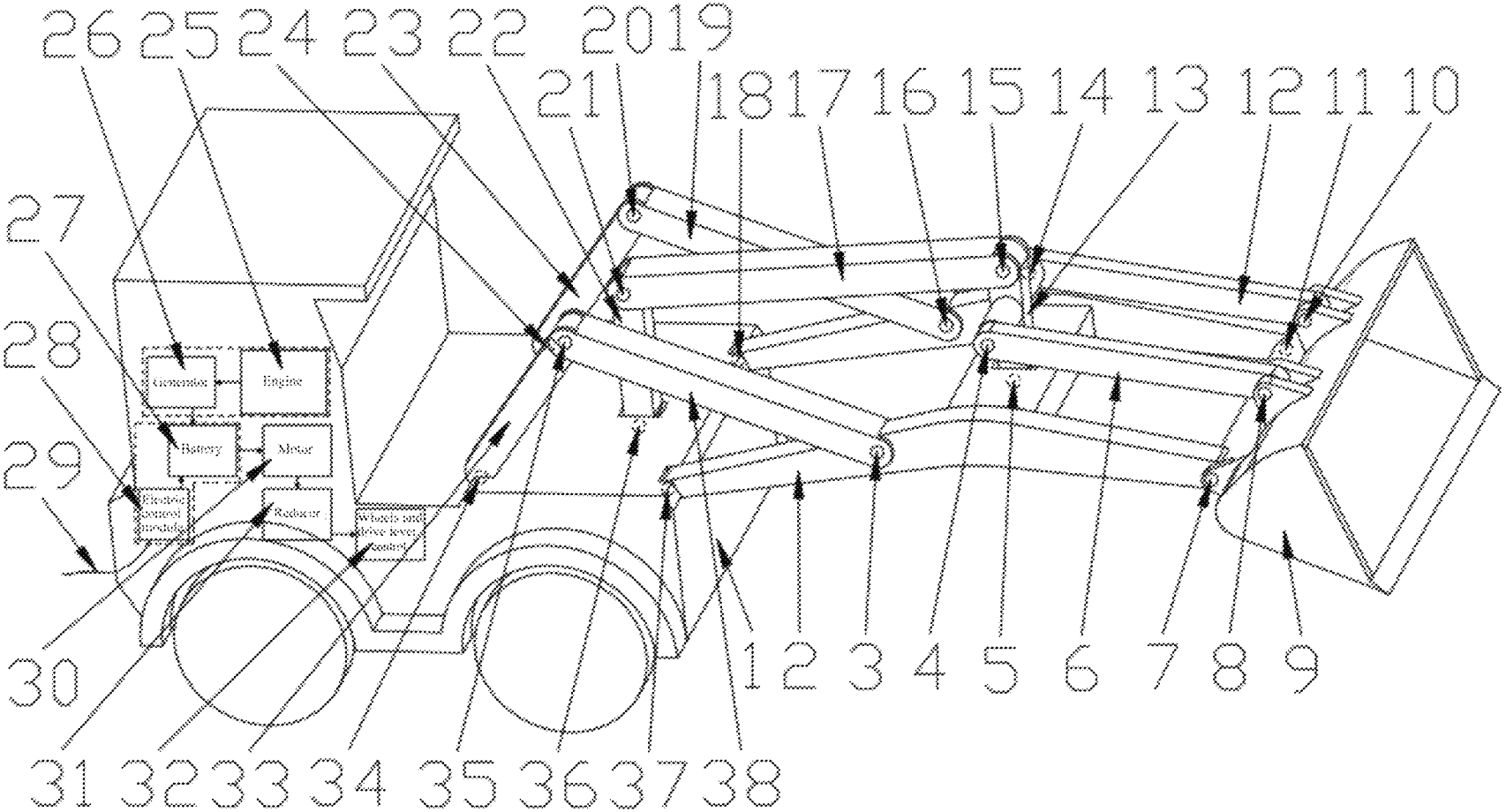
FIG. 1 is a diagram showing a range-extended numerical controlled link mechanism electric loader provided in the present invention.

In the drawings: rack 1; movable arm 2; seventeenth revolute joint 3; ninth revolute joint 4; eighth revolute joint 5; first tension lever 6; third revolute joint 7; eleventh revolute joint 8; loader bucket 9; twelfth revolute joint 10; fourth revolute joint 11; second tension lever 12; rocker arm 13; tenth revolute joint 14; seventh revolute joint 15; eighteenth revolute joint 16; first link lever 17; second revolute joint 18; third link lever 19; sixteenth revolute joint 20; sixth revolute joint 21; first drive lever 22; third drive lever 23; fourteenth revolute joint 24; engine 25; generator 26; battery 27; electric control module 28; external charging accessory 29; motor 30; reducer 31; wheel and drive lever controller 32; second drive lever 33; thirteenth revolute joint 34; fifteenth revolute joint 35; fifth revolute joint 36; first revolute joint 37 and second link lever 38.

Specific Embodiments

Hereinafter in conjunction with the drawings the technical solutions in the present invention will be elaborated to a further extent.

With reference to FIGS. 1, 2, 3, 4 and 10, the range-extended numerical controlled link mechanism electric loader comprises a vehicle-loaded rechargeable energy storage device, a vehicle-loaded auxiliary power supply device, a motor, a reducer 31, a numerical controlled link lever loading mechanism and a rack 1. The vehicle-loaded rechargeable energy storage device is provided on the rack 1, the vehicle-loaded rechargeable energy storage device comprises batteries 27, an electric control module 28 and at least one charging port 29, the vehicle-loaded auxiliary power supply device comprises an engine 25 and a generator 26, the vehicle-loaded auxiliary power supply device and the vehicle-loaded rechargeable energy storage device are interconnected, power sent by the vehicle-loaded auxiliary power supply device is sent to the vehicle-loaded rechargeable energy storage device, the motor is connected with the batteries, a rotation shaft of the motor is connected to a drive shaft of the reducer, a driven shaft of the reducer is connected with a controller of wheels and the drive lever and then connected with the wheels and the drive lever, and a main function of the controller of the wheels and the drive lever is to distribute power as required to the wheels and the drive lever.

Figure 2:
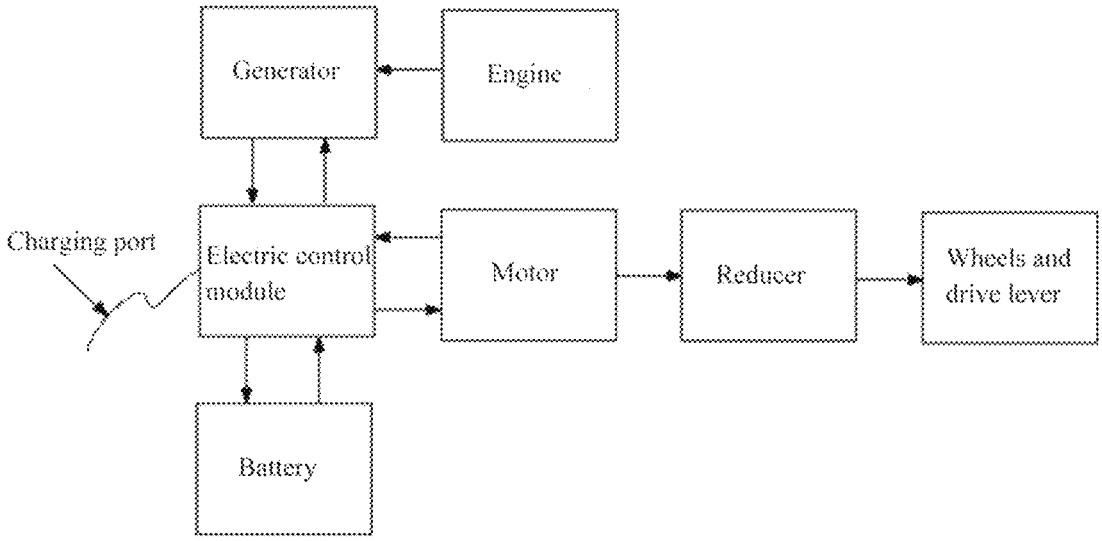
FIG. 2 is a diagram showing principles of the range-extended numerical controlled link mechanism electric loader provided in the present invention.
Figure 3:
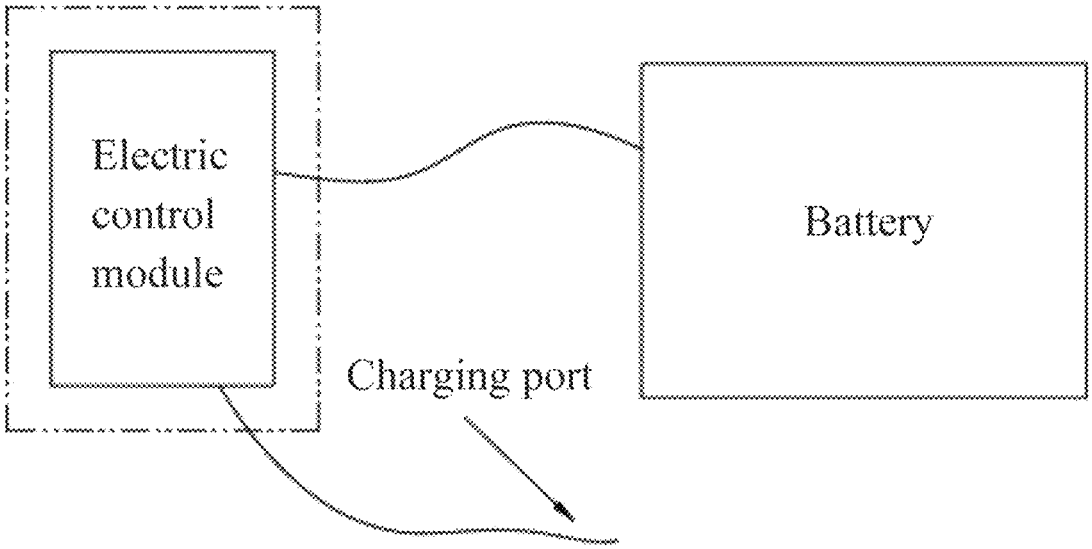
FIG. 3 is a diagram showing a vehicle-loaded chargeable energy storage device of the range-extended numerical controlled link mechanism electric loader provided in the present invention.
Figure 4:
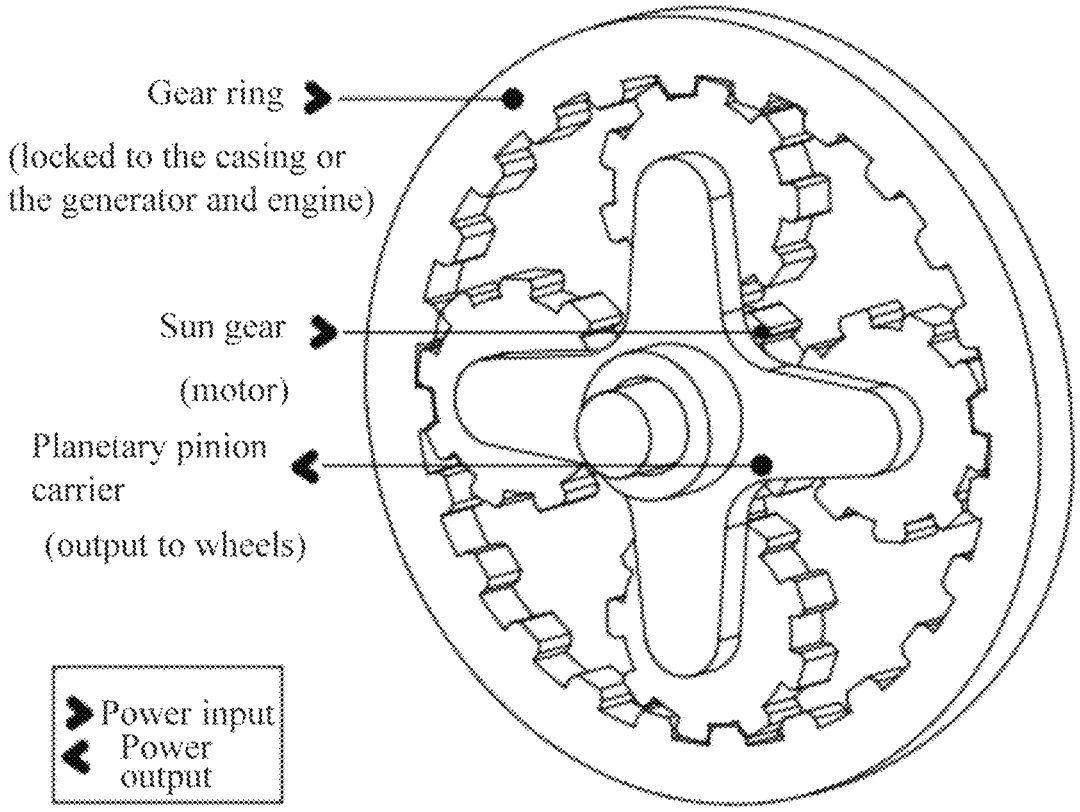
FIG. 4 is a diagram showing an energy distribution mechanism of the range-extended numerical controlled link mechanism electric loader provided in the present invention.
Figure 5:
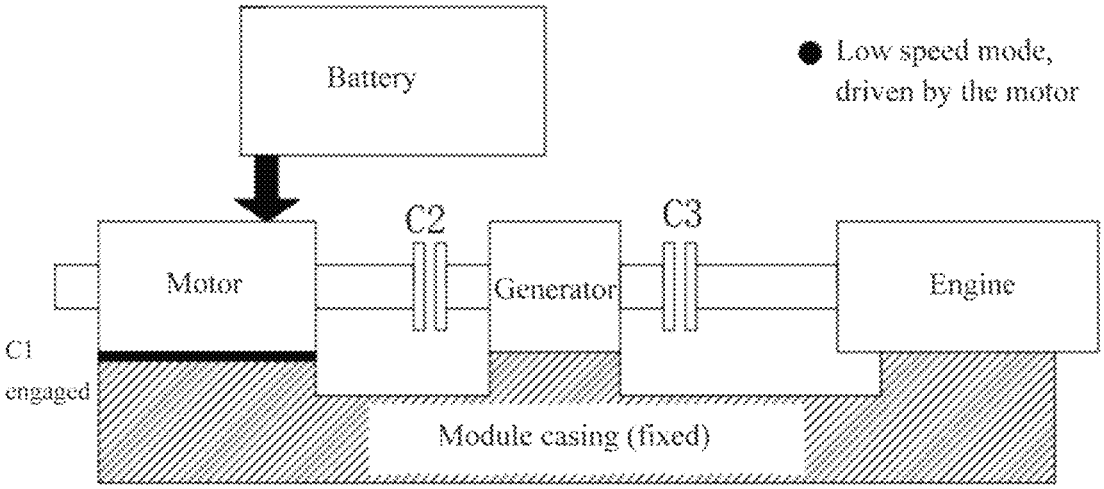
FIG. 5 is a diagram showing the range-extended numerical controlled link mechanism electric loader working in a low speed mode as provided in the present invention.
Figure 6:
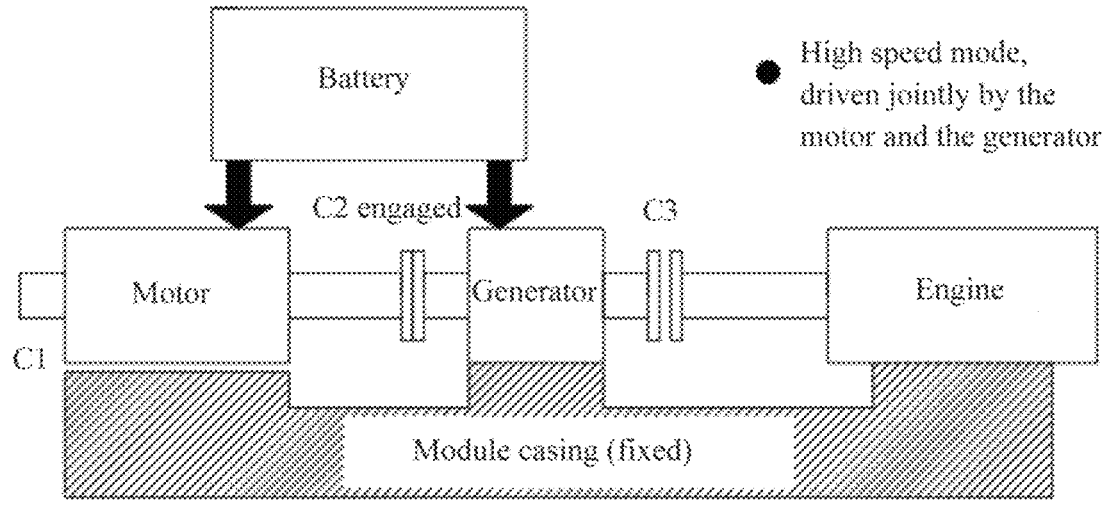
FIG. 6 is a diagram showing the range-extended numerical controlled link mechanism electric loader working in a high speed mode as provided in the present invention.
Figure 7:
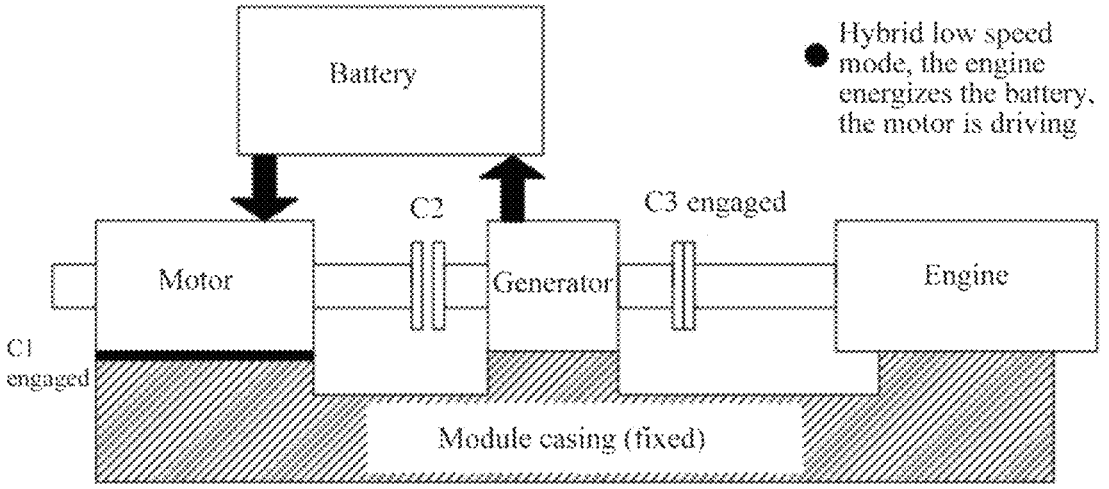
FIG. 7 is a diagram showing the range-extended numerical controlled link mechanism electric loader working in a hybrid low speed mode as provided in the present invention.
Figure 8:
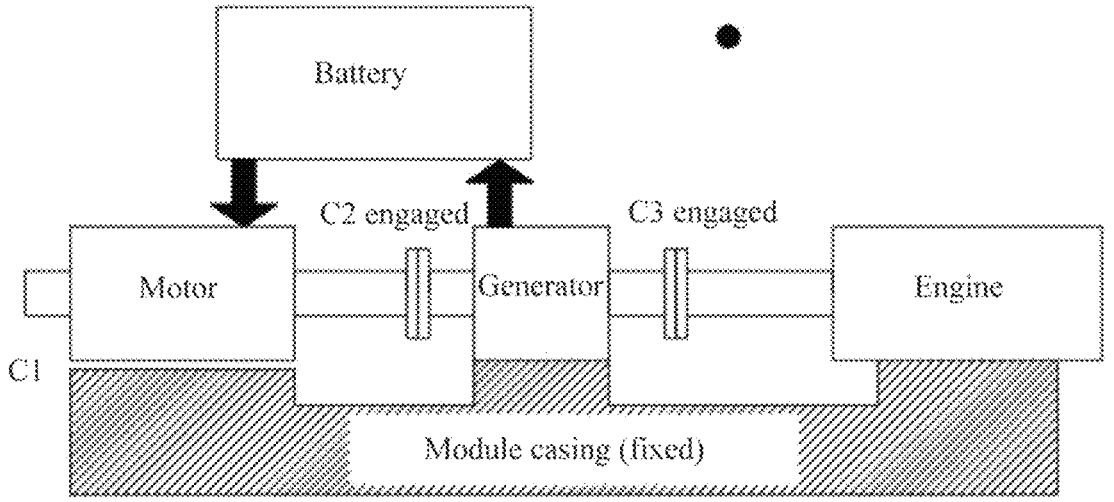
FIG. 8 is a diagram showing the range-extended numerical controlled link mechanism electric loader working in a hybrid high speed mode as provided in the present invention.
Figure 9:
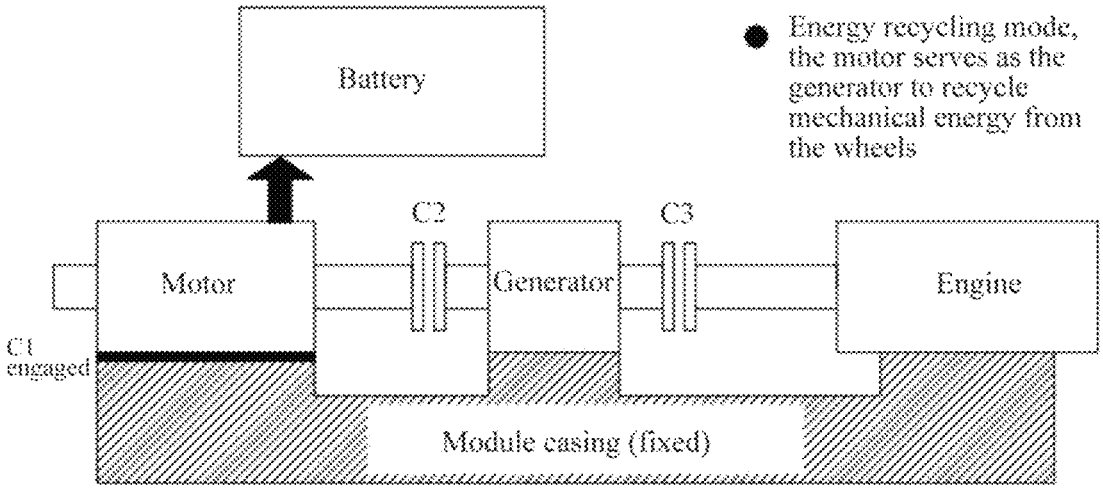
FIG. 9 is a diagram showing the range-extended numerical controlled link mechanism electric loader working in an energy recycling mode as provided in the present invention.

With reference to FIGS. 1, 2 and 3, the vehicle-loaded rechargeable energy storage device comprises batteries 27 and an electric control module 28, and the vehicle-loaded rechargeable energy storage device is provided with an external charging accessory 29. The external charging accessory 29 is connected with the electric control module via connection lines and charges the batteries, when the numerical controlled link mechanism electric loader is not travelling nor loading, the external charging accessory 29 can be used to charge the batteries 27 via the electric control module 28, when the numerical controlled link mechanism electric loader is travelling or performing loading tasks, the vehicle-loaded auxiliary power supply device can be turned on to charge the batteries so to meet recharging mileage and loading time requirements without requiring stopping to find charging stations to charge the batteries 27.

With reference to FIGS. 1, 2, 3 and 4, the vehicle-loaded auxiliary power supply device comprises an engine 25 and a generator 26, the engine 25 is configured to drive the generator 26 to charge the batteries 27, and the engine 25 does not drive the wheels and the drive lever, no gear box is required, in other words, a fuel/diesel generator is installed on a common electric vehicle; the power distribution mechanism is configured to control distribution of the power according to energy storage conditions of the vehicle-loaded rechargeable energy storage device. The power distribution mechanism comprises a planetary gear system.

An end of the generator 26 is connected with a clutch C2, another end of the generator 26 is connected with a clutch C3, the clutch C2 is connected with a ring gear of the planetary gear system, and the clutch C3 is connected with the engine 25. The reducer is connected with a planetary pinion carrier, when the batteries 27 do not have sufficient power, turn on the vehicle-loaded auxiliary power supply device, power can be fed to the batteries 27 so to satisfy endurance mileage and loading working time requirements without stopping to charge the batteries 27.

With reference to FIGS. 1-9, a drive system comprising the vehicle-loaded auxiliary power supply device, the vehicle-loaded rechargeable energy storage device and the motor has totally 5 working modes, namely: low speed mode, high speed mode, hybrid low speed mode, hybrid high speed mode and energy recycling mode. The motor is a motor with relatively large power, the generator is a generator with relatively low power, and both the motor and the generator can work both as a motor and a generator. The motor is mainly configured to convert electric energy to mechanical energy, and the generator is configured primarily to generate power. The five working modes control distribution of power by the three clutches. The three clutches are named to be respectively the clutch C1, the clutch C2 and the clutch C3, the clutch C1 is configured to control connection between the gear ring of the planetary gear system and the casing, when the clutch C1 connects the gear ring of the planetary gear system with the casing, the gear ring of the planetary gear system is fixed on the casing; the clutch C2 is configured to control connection between the generator 26 and the gear ring of the planetary gear system, and the clutch C3 is configured to control connection between the engine 25 and the generator 26.

Under the low speed mode, the clutch C1 is engaged, the clutch C2 and the clutch C3 are disengaged, the generator 26 and the engine 25 stop rotating, the gear ring is fixed, at this time, the power source is the batteries 27, that is, the loader works at a purely electric mode.

Under the high speed mode, the clutch C2 is engaged, the clutch C1 and the clutch C3 are disengaged, the generator 25 stops rotation, the generator 26 works as a motor at this time to drive the gear ring to rotate, the motor drives the sun gear to rotate, the generator drive the gear ring to rotate, simultaneous rotation of both the gear ring and the sun gear drives the planetary pinion carrier to revolve, so that the power is transmitted to the reducer, the generator 26 works as a motor to drive the gear ring to rotate, the rotation speed of the another motor connected with the sun gear is reduced, thus energy utility rate is improved.

Under the hybrid low speed mode, the clutch C1 and the clutch C3 are engaged, the clutch C2 is disengaged, the engine 25 is running, the gear ring is fixed, the engine 25 drives the generator 26 to generate power and charge the batteries 27, in the meanwhile, the batteries 27 provide power for the motor to drive the sun gear to rotate, and the planetary pinion carrier follows the sun gear to rotate so to transmit power to the reducer. In the hybrid high speed mode, the clutch C2 and the clutch C3 are engaged, the clutch C1 is disengaged, the engine 25 and the generator 26 drive the gear ring to rotate and generate power, the motor drives the sun gear to rotate, the gear ring rotates simultaneously with the sun gear, the planetary pinion carrier is driven to rotate so as to transmit the power to the reducer, the engine 25 drives the gear ring to rotate, the rotation speed of another motor connected with the sun gear is reduced and energy utility rate of the motor is improved.

Under the energy recycling mode, the clutch C1 is engaged, the clutch C2 and the clutch C3 are disengaged, the engine 25 and the generator 26 stop rotating, the wheels drive the planetary pinion carrier to rotate, the gear ring is fixed, the sun gear rotates along with the planetary pinion carrier, at this time, the motor with higher power will charge the batteries 27 as a generator, the sun gear is connected with the motor, the planetary pinion carrier is connected with the reducer, power is directly output to the controller of the wheels and the drive lever, and distributed to drive the loader to travel and drive the range-extended numerical controlled link mechanism electric loader to perform loading works via the wheels and the drive lever, and the gear ring is connected with the casing (fixed) of the power distribution mechanism or connected with the generator 26 and the engine 25 as per actual conditions.

During actual work of the range-extended numerical controlled link mechanism electric loader, the working mode can be switched as per actual demands to meet requirements of endurance mileage and loading working time of the range-extended numerical controlled link mechanism electric loader.

Figure 10:
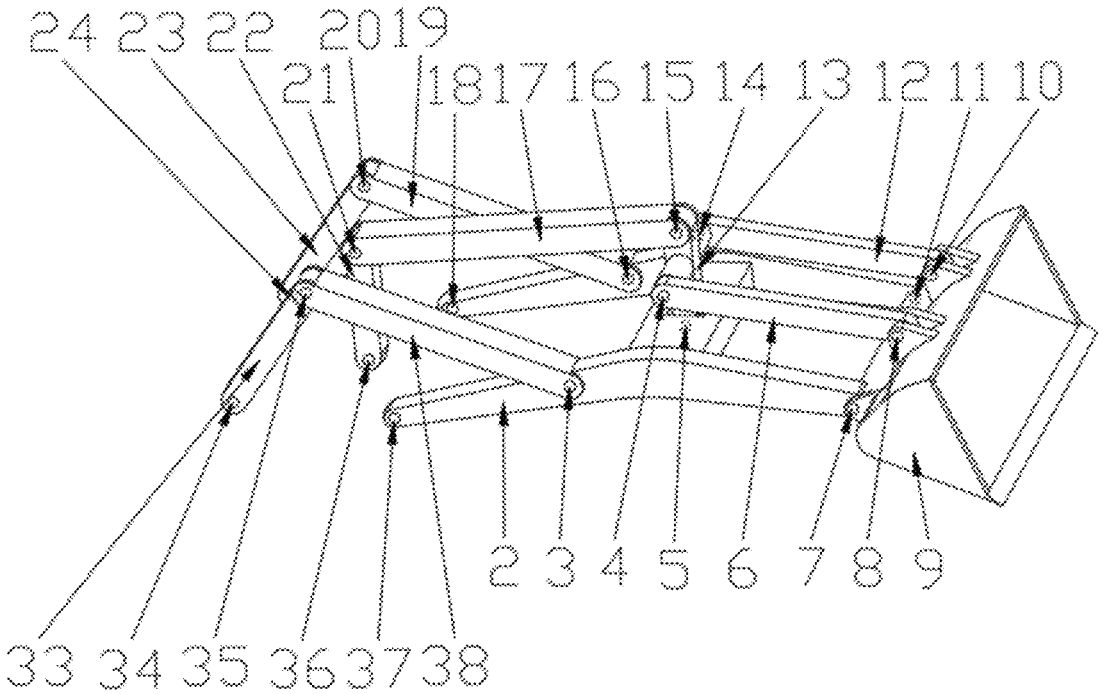
FIG. 10 is a diagram showing a loading mechanism of the range-extended numerical controlled link mechanism electric loader provided in the present invention.

With reference to FIGS. 1 and 10, the range-extended numerical controlled link mechanism electric loader comprises a first drive lever 22, a first link lever 17, a rocker arm 13, a first tension lever 6, a second tension lever 12, a movable arm 2, a loader bucket 9, and a movable arm elevating mechanism, one end of the movable arm 2 is connected to the rack 1 via a first revolute joint 37 and a second revolute joint 18, another end of the movable arm 2 is connected with the loader bucket 9 via a third revolute joint 7 and a fourth revolute joint 11; an end of the movable arm elevating mechanism is connected with rack 1 and another end thereof is connected with the movable arm 2; an end of the first drive lever 22 is connected to the rack 1 via a fifth revolute joint 36, another end thereof is connected with an end of the first link lever 17 via a sixth revolute joint 21, and another end of the first link lever 17 is connected with an end of the rocker arm 13 via a seventh revolute joint 15, another end of the rocker arm 13 is connected to the movable arm via an eighth revolute joint 5; another two ends of the rocker arm are respectively connected with either ends of the first tension lever 6 and the second tension lever 12 via a ninth revolute joint 4 and a tenth revolute joint 14, another ends of the first tension lever 6 and the second tension lever 12 are respectively connected to the loader bucket via an eleventh revolute joint 8 and a twelfth revolute joint 10; the first drive lever driven by the motor on the rack 1 rotates against the revolute joints, the rotation is transmitted by the first link lever 17, the rocker arm 13, the first tension lever 6 and the second tension lever 12 so as to drive the loader bucket 9 to revolve against the third revolute joint 7 and the fourth revolute joint 11 on the movable arm 2. The movable arm elevating mechanism comprises a second drive lever 33, a second link lever 38, a third drive lever 23, and a third link lever 19, either ends of the second drive lever 33 and the third drive lever 23 are respectively connected with the second link lever 33 and the third link lever 19 via a fifteenth revolute joint 34 and a sixteenth revolute joint 20, and the second link lever 38 and the third link lever 19 are respectively connected with the movable arm 2 via a seventeenth revolute joint 3 and an eighteenth revolute joint 16. The movable arm 2 elevates or descends when driven by the second drive lever 33 and the third drive lever 23, and loading work is completed by cooperation of the movable arm 2 and overturn of the loader bucket 9.

The invention claimed is:

1. A range-extended numerical controlled link mechanism electric loader, comprising a rack, a numerical controlled link lever loading mechanism, wheels and a drive system, wherein, the drive system is provided on the rack, drive levers of the numerical controlled link lever loading mechanism are connected with an output end of the drive system via at least one clutch, the wheels are provided at a lower portion of the rack, and the wheels are connected with the output end of the drive system via the at least one clutch, wherein the drive system comprises: an engine, a generator, at least one battery, a motor, the at least one clutch, an electric control module, a power distribution mechanism and a reducer, a rotation shaft of the engine is connected with a first clutch, the first clutch is connected with an end of a main shaft of the generator, a second clutch is connected at another end of the main shaft of the generator, the second clutch is connected with the power distribution mechanism, the power distribution mechanism is connected with a main shaft of the motor; the power distribution mechanism comprises a planetary gear system, a planet pinion carrier of the planetary gear system is connected with a drive shaft of the reducer, a driven shaft of the reducer is connected with the wheels and the drive shaft; a sun gear of the planetary gear system is connected with a rotating shaft of the motor, a gear ring of the planetary gear system is connected with a housing or the main shaft of the generator; the generator is connected with the electric control module and the at least one battery is connected with the electric control module and then connected with the motor;

further comprising a first drive lever, a first link lever, a rocker arm, a first tension lever, a second tension lever, a movable arm, a loader bucket, and a movable arm elevating mechanism, an end of the movable arm is sequentially connected with a first revolute joint, a second revolute joint and then the rack, another end of the movable arm is connected with the loader bucket via a third revolute joint and a fourth revolute joint, an end of the movable arm elevating mechanism is connected with the rack and another end thereof is connected with the movable arm, an end of the first drive lever is connected to the rack via a fifth revolute joint, another end of the first drive lever is connected with the first link lever via a sixth revolute joint, another end of the first link lever is connected with an end of the rocker arm via a seventh revolute joint, another end of the rocker arm is connected with the first link lever via an eighth revolute joint, another two ends of the rocker arm are respectively connected with the first tension lever and the second tension lever via a ninth revolute joint and a tenth revolute joint, another ends of the first tension lever and the second tension lever are connected with the loader bucket via an eleventh revolute joint and a twelfth revolute joint, the first drive lever driven by the motor located on the rack rotates against the revolute joints, movement is transmitted via the first link lever, the rocker arm, the first tension lever and the second tension lever, thereafter, the loader bucket pivots against the third revolute joint and the fourth revolute joint on the movable arm; the movable arm elevating mechanism comprises a second drive lever, a second link lever, a third drive lever and a third link lever, either ends of the second drive lever and the third drive lever are respectively connected to the rack via a thirteenth revolute joint and a fourteenth revolute joint, another ends thereof are respectively connected with the second link lever and the third link lever via a fifteenth revolute joint and a sixteenth revolute joint, and the second link lever and the third link lever are respectively connected with the movable arm via a seventeenth revolute joint and an eighteenth revolute joint.

2. The range-extended numerical controlled link mechanism electric loader according to claim 1, wherein the electric control module further comprises a charging module, wherein charging ports are connected in the charging module.

3. The range-extended numerical controlled link mechanism electric loader according to claim 1, wherein the electric control module further comprises a charging module, wherein charging ports are connected in the charging module.

* * * * *